US006176384B1

(12) United States Patent
Voloshin

(10) Patent No.: US 6,176,384 B1
(45) Date of Patent: Jan. 23, 2001

(54) SPILL-PROOF SNACK CONTAINER

(76) Inventor: Corri Voloshin, c/o 880, 550-6th Avenue S.W., Calgary, Alberta T2P 0S2 (CA)

( * ) Notice: Under 35 U.S.C. 154(b), the term of this patent shall be extended for 0 days.

(21) Appl. No.: 09/488,299

(22) Filed: Jan. 20, 2000

(51) Int. Cl.[7] ..... B65D 51/00
(52) U.S. Cl. ..... 220/253; 220/229; 220/254
(58) Field of Search ..... 220/253, 254, 220/229

(56) References Cited

U.S. PATENT DOCUMENTS

| | | | | |
|---|---|---|---|---|
| 1,896,976 | * | 2/1933 | Schifferdecker | 220/253 |
| 3,478,922 | * | 11/1969 | Mole | 220/229 X |
| 4,328,904 | | 5/1982 | Iverson . | |
| 4,494,668 | | 1/1985 | Lottick . | |
| 4,606,893 | * | 8/1986 | Sangster | 220/253 X |
| 4,714,174 | | 12/1987 | Williams . | |
| 4,884,717 | | 12/1989 | Bussard et al. . | |
| 5,123,574 | * | 6/1992 | Poulos | 220/253 X |
| 5,165,564 | * | 11/1992 | Prout et al. | 220/229 X |
| 5,388,731 | | 2/1995 | Mengeu et al. . | |
| 5,449,085 | | 9/1995 | Brun, Jr. . | |
| 5,686,700 | * | 11/1997 | Carpinella | 220/253 X |

* cited by examiner

*Primary Examiner*—Steven Pollard
(74) *Attorney, Agent, or Firm*—Gene Scott-Patent Law & Venture Group

(57) ABSTRACT

The present invention provides a spill-proof container having a two-panel cover such that an upper panel is stationary, while a lower panel is enabled for rotational motion relative to the upper panel. As each panel has an aperture in it, and the lower panel provides a device for manual actuation of the rotational motion of the lower panel relative to the upper panel, the invention enables one to reach inside of the container when the lower aperture is positioned by the rotative motion adjacent to the upper aperture. Therefore, the food is held fresh and protected from exposure to the undesirable moisture or dryness of the fresh air, while it is easily accessible without removal of the container's cover. This objective is further enhanced by a resilient, snap-action engagement of an L-shaped annular container cover rim with the top annular rim of the container. Additionally, the lower panel aperture is provided with a flexible surface which is split by radial slits into flexible fingers. The flexible fingers are such that they are capable of bending into the container when a hand reaches inside of the container for food, and resiliently return to their initial planar position, automatically closing the container when the hand is removed. Consequently, no food will spill out if the container is tilted too far or accidentally tipped over.

4 Claims, 1 Drawing Sheet

SPILL-PROOF SNACK CONTAINER

BACKGROUND OF THE INVENTION

1. Field of the Invention

This invention relates generally to spill-proof containers, and more particularly to a spill-proof snack container with features adapted for snap-action resilient closure and a cover providing a plurality of flexible fingers which permits easy access to the container by a hand, but when not in use provides a moisture seal.

2. Description of the Related Art

The following art defines the present state of this field: Iverson, U.S. Pat. No. 4,328,904 describes a spill proof container and closure. The closure incorporates a plurality of overlapping arcuate flaps of a resilient and flexible nature. Through the use of the overlapping, arcuate flaps a container embodying the closure of the present invention may be relatively tightly sealed to prevent spillage and in addition, may be directly accessed by the user by the penetration of the user's hand through the approximate center of the closure surface. Although the closure is intended for use with the container, the closure may be used for a variety of purposes.

Lottick, U.S. Pat. No. 4,494,668 describes a non-spillable drinking container which is manufactured in assemblable parts and which provides stackability and reduced manufacturing costs. The drinking container utilizes a perforated expandable diaphragm mounted or formed over a base plate. The container is preferably frustro-conical in shape to provide stackability. A drinking tube is attachable to the expandable diaphragm and a top is sealably mountable over the tube. Drinking is accomplished by pulling upwardly on the tube to expand the diaphragm opening the perforations therein, allowing fluid flow through the perforations and up the straw to the mouth of the drinker.

Williams, U.S. Pat. No. 4,714,174 describes a "spill-proof" bowl, particularly suitable for a child, for a dry, granular foodstuff to be eaten by hand, comprising a bowl having a hollow interior therein substantially covered over by a cover located on an open end of the bowl for substantially closing off the hollow interior. A tubular portion centrally located in the cover terminates with an inwardly curved edge at its lower extremity in a relatively small, open end for forming an open closure spaced in the hollow interior below the midpoint between the cover and the base to provide visual and selective access to the dry, granular foodstuff located in the hollow interior of the bowl when open. A portion of the tubular portion extends upwardly and terminates in an open, upper end spaced above the cover. A tubular passage depends downwardly through the tubular portion and communicates with the hollow interior of the bowl by means of the open closure means. A cap spaced above the bowl cover is removably located on the open, upper end, completely closing off the open closure and egress and access to the dry, granular foodstuff. The bowl, when suitably sized, can also be used by adults as a "spill-proof" bowl for foodstuff, and, in either event, the diameter of the tubular passage is just a little bit greater than the lateral dimension of the human hand for whom it was designed, the total opening to the hollow interior being otherwise no more than that necessary for hand access.

Bussard et al., U.S. Pat. No. 4,884,717 describes a container used for nibbling snack food, including a receptacle and a top cover made of flexible material, the cover having crossing slits forming a circle of tongues which when flexed downwardly by a person's fingers reaching inside for picking up the food, thus form a self-closing dispensing opening through the cover.

Mengeu et al., U.S. Pat. No. 5,388,731 describes a cap and dispensing fitment combination for a container. The cap has an end wall and a skirt extending axially from the periphery of the end wall, the cap being adapted to engage the neck of the container. The end wall of the cap has an annular flange that extends axially and radially outwardly therefrom, the annular flange terminating in a free end surface that facilitates securing the dispensing fitment to the cap. The dispensing fitment comprises an end wall having at least one opening therein, the annular flange engaging into the opening. The dispensing fitment has a sidewall extending axially from the periphery of the end wall and is adapted to engage the container when the combination is placed on the container and to retain the dispensing fitment on the container even as the cap is removed from the container.

Brun, Jr., U.S. Pat. No. 5,449,085 describes a blow molded plastics container including an injection molded annular neck portion which is sealed by injection molding to an annular wall portion of an injection molded top end wall having a part-spherical center portion. The center portion has five circumferentially spaced and upwardly projecting annular lip seals, two of which surround openings within the top end wall. An injection molded rotatable closure snap-fits onto the neck portion and has a mating part-spherical center portion which engages the lip seals. The closure has one opening which is selectively and progressively alignable with the annular lip seals in response to indexing the closure in one direction. An integrally molded one-way latch extends between the center portions of the closure and top end wall and prevents reverse rotation of the closure except between a consumer open position and a The prior art teaches various apparatuses for holding foods for human consumption. However, the prior art does not teach that the container may have a cover comprised of two mutually rotatable panels providing a plurality of flexible fingers so as to enable easy access inside of the container while protecting the contents of the container from an inadvertent spill. Moreover, the prior art does not teach that such a container cover may be of a resilient, snap-action type for preventing spoilage caused by undesirable exposure to dryness or moisture. The present invention fulfills these needs and provides further related advantages as described in the following summary.

SUMMARY OF THE INVENTION

The present invention teaches certain benefits in construction and use which give rise to the objectives described below.

The present invention provides a spill-proof container having a two-panel cover such that an upper panel is stationary, while a lower panel is enabled for rotational motion relative to the upper panel. As each panel has an aperture in it, and the lower panel provides a device for manual actuation of the rotational motion of the lower panel relative to the upper panel, the invention enables one to reach inside of the container when the lower aperture is positioned by the rotative motion adjacent to the upper aperture. Therefore, the food is held fresh and protected from an exposure to moisture or dryness, while it is easily accessible without removal of the container's cover. This objective is further enhanced by a resilient, snap-action engagement of an L-shaped annular groove in the container cover. Additionally, the lower panel aperture is provided with a flexible surface which is separated by radial slits into flexible fingers. The flexible fingers are such that they are capable of bending into the container when a hand reaches inside of the container for food, and resiliently return to their initial planar position, automatically closing the container when the hand is removed. Consequently, no food will spill out if the container is tilted too far or accidentally tipped over.

A primary objective of the present invention is to provide a spill-proof snack container having advantages not taught by the prior art.

Another objective is to provide a spill-proof food container which facilitates easy access to the contents of the container without removing the container's cover.

A further objective is to provide a cover for a food container with a snap-action resilient engagement with the container, thus minimizing food's exposure to dryness or moisture of the fresh air and securing freshness of the contents of the container.

A further objective is to provide a food container which is adapted for spillage-proof use and which permit easy access to the container by hand, but prevents an inadvertent spillage of the contents of the container if the container is tilted too far or accidentally tipped over.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawing illustrate the present invention. In such drawings.

DETAILED DESCRIPTION OF THE INVENTION

Many types of containers and closures are well known in the prior art. Some of the containers provide for rotatable two-panel covers providing an easy opening and reclosing of the container upon rotation of a one cover panel relative to another. Other containers have been used having a cover with crossing resilient slits which, when flexed downwardly by a person's fingers form a self-closing dispensing opening through the cover. However, all types of the covers described in the prior art exhibit significant disadvantages. Thus, the containers with rotatable two-panel covers are subject to exposure of the contents of the container to spillage through the open aperture. While this problem may be considered only an inconvenience by adults, the problem is a significant one when the container is intended for use by children. The other types of container covers, for instance, those with the open slits, while preventing the contents of the container from an inadvertent spillage, leave the contents exposed to air, thus exposing the food inside of the container to dryness, wetness and potential early spoilage.

Figure 1:
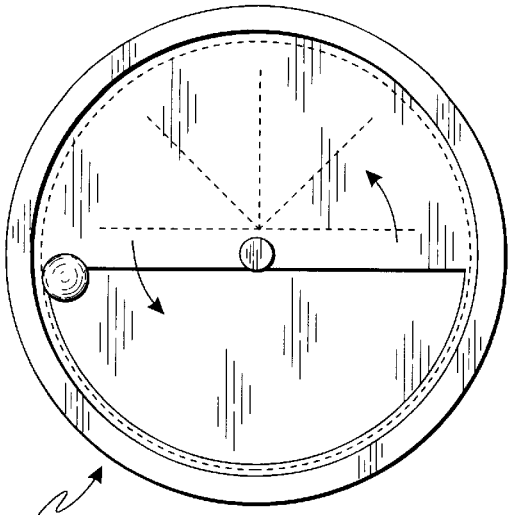
FIG. 1 is a top plan view of the preferred embodiment of the present invention showing a lower panel of the cover of the invention in a closed position.
Figure 3:
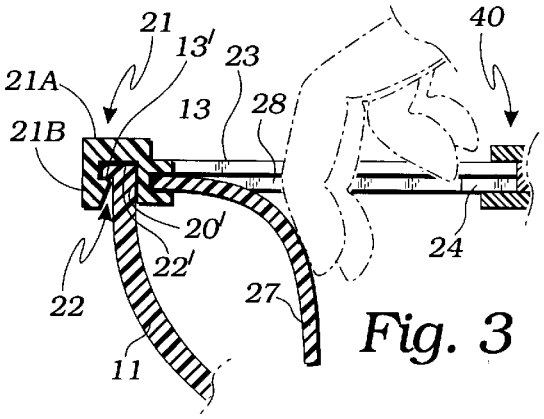
FIG. 3 is a partial sectional view thereof taken along line 3—3 in FIG. 2 and showing flexible fingers of the lower panel bending, as they might be by pressure of a hand reaching into a container.
Figure 4:
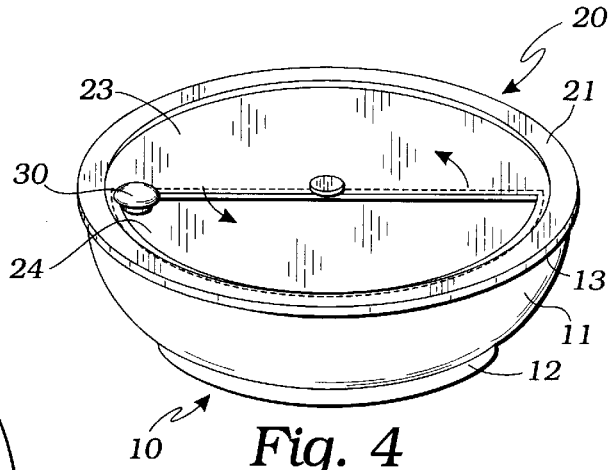
FIG. 4 is a perspective view of the preferred embodiment of the present invention as shown in FIG. 1.

The above-described drawing FIGS. 1 through 5 illustrate the invention, a storage apparatus 5. Referring to FIGS. 3 and 4, an embodiment of the present invention comprises a storage container 10 which includes a side wall 11 and a bottom wall 12, the side wall 11 extends upwardly from the bottom wall 12 and is integral thereto. The sidewall 11 terminates at an open top 13 and provides an annular lip 13' which projects outwardly from and defines the open top 13 of the storage container 10. The storage container 10 is preferably manufactured by injection molding process of rigid or semi-rigid plastic material, in one piece, thus making the invention economical in production and available to replace more elaborate and expensive articles used for the same purposes.

The storage apparatus 5 further comprises a container cover 20 which provides a container cover annular rim 21. Referring to FIGS. 3 and 4 the annular rim 21 is integrally injection molded around a container cover base 20' and projects upwardly and outwardly therefrom. Preferably, as shown in FIG. 3, the container cover annular rim 21 has an annular grove 22 therewithin such that the annular lip 13' of the side wall 11 is accepted by the annular groove 22 in a snap-action, removable engagement. Thus, the annular groove 22 and the annular lip 13' form a positive moisture-tight connection securing the container cover 20 onto the storage container 10. In the preferred embodiment, the annular groove 22 of the container cover annular rim 21 is L-shaped and consists of two integral elements. While an inner rim element 21A is immediately adjacent to the container cover base 20', a peripheral rim element 21B extends downwardly from the element 21A. Thus, the inner element 21A and a peripheral element 21B form a convergent groove sidewall surface 22' wherein the peripheral rim element 21B is enabled for resilient reception of the annular lip 13' of the storage container 10. Consequently, when the annular lip 13' is pressed into the convergent side wall surface 22', the resilient lock-action engagement with the peripheral rim element 21B tightly locks the annular lip 13' within the convergent wall side surface 22". The container cover 20 is preferably manufactured by injection molding of plastic, such as polyethylene, polypropylene or other light-weight structural or semi-structural cost effective plastic material.

The container cover 20 further provides a stationary upper panel 23 defined by the container cover annular rim 21 and positioned for covering the open top 13 of the storage container 10. Inventively, the upper panel 23 is pivotally engaged by a pivot means 40 with a lower panel 24 so that the lower panel 24 is enabled for rotating relative to the upper panel 23. In the preferred embodiment the pivot means 40 is sized to enable rotational motion of the lower panel 24. Alternatively, the pivot means 40 may be a fastener or a bolt which allows the pivot means 40 to facilitate the rotational engagement between the lower 23 and the upper 24 panels of the container's cover.

Figure 2:
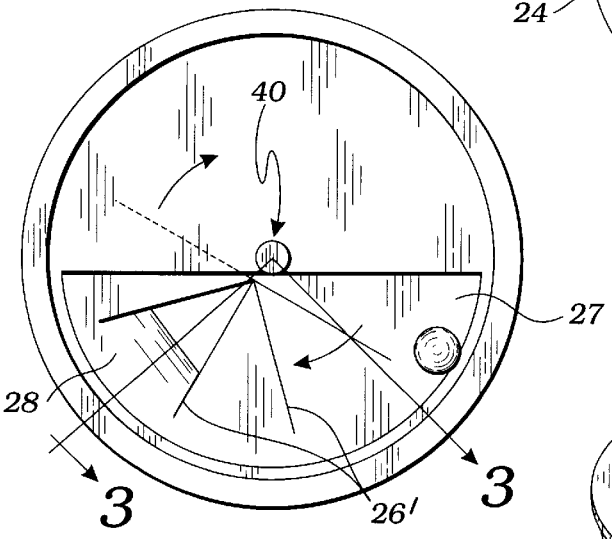
FIG. 2 is a plan view thereof showing the lower panel of the cover being rotated to position a lower panel aperture adjacent to an upper panel aperture.

Referring to FIGS. 2, 3 and 4, the lower panel 24 is also defined by the container cover annular rim 21 and provides a lower panel aperture 28. The upper panel 23 has an upper panel aperture 27 therein. The upper 27 and the lower 28 panel apertures are sized and positioned so as to enable a complete closure of the container 20 by rotation of the lower panel 24 relative to the upper panel 23.

Figure 5:
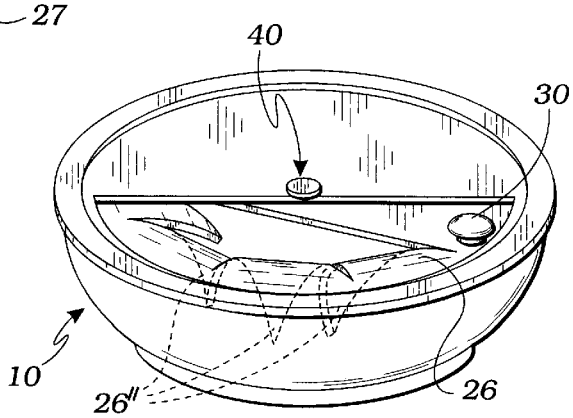
FIG. 5 is a perspective view similar to that of FIG. 4 showing the flexible fingers of the lower panel pressed inwardly.

Advantageously, as shown in FIGS. 2 and 5, the lower panel aperture 28 comprises a surface 26 which is divided by a plurality of radial slits 26' so as to define a plurality of flexible fingers 26". The flexible fingers 26" laying contiguously in planar congruence to each other, define a lower panel aperture 28 in the lower panel 23.

The lower panel 23 further comprises a means for rotational actuation 30 of the lower panel 24 relative to the upper panel 23. In a preferred embodiment the means for rotational actuation 30 is a mushroom-shaped handle, but it may take any compact shape within the physical confines of the panels. This handle is fixedly attached to the lower panel 23, by any type of common fastener such as a screw, and extends therefrom generally perpendicularly to the lower panel 23 through the upper panel aperture 27. Consequently, the rotational actuation means 30 is positioned to enable a grip by a hand for the purposes of actuation of the rotational motion of the lower panel 24 relative to the upper panel 23. When a rotational motion is attempted by a hand grasping the means for rotational actuation 30 and pulling it clockwise- or counterclockwise, the means for rotational actuation 30 is enabled to position the lower panel aperture 28 adjacent to the upper panel aperture 27, thus providing access to the contents of the container 10 through the coinciding upper 27 and lower 28 panel apertures.

In an open position, when a hand reaches through the upper 27 and the lower 28 panel apertures, hand pressure, directed towards the inside of the container 10, is met by the divided surface 26, which causes the flexible fingers 26" to bend inwardly into the storage container 10. Inventively, the flexible fingers 26" are resiliently biased and, therefore, enabled for returning to planar congruence when pressure is released therefrom. Consequently, as shown in FIG. 3, when the hand's pressure is applied to the divided surface 26, the flexible fingers 26" bend, forming a self-closing dispensing opening through the cover and enabling the hand to reach for the food inside of the container 10. After the hand is removed, the pressure on the flexible fingers 26" ceases to exist, whereupon the flexible fingers 26" return to their initial planar position thus restoring congruence of the surface 26", which, in turn, provides relatively tight sealing and prevents the contents of the container 10 from an inadvertent spill and potential early spoilage.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A storage apparatus comprising:

a storage container including a side wall integral with a bottom wall, the sidewall providing an annular lip defining an open top of the storage container;

a container cover providing a container cover annular rim having an annular groove therewithin, the annular groove adapted for accepting the annular lip of the side wall in snap-action, removable engagement for securing the container cover onto the storage container;

the container cover further providing a stationary upper panel positioned for covering the open top of the storage container, the upper panel having an upper panel aperture therein;

a lower panel pivotally engaged with the upper panel for rotating relative thereto, the lower panel providing a plurality of radial slits defining a plurality of flexible fingers, the fingers laying contiguously in planar congruence for defining a lower panel aperture in the lower panel;

a means for rotational actuation of the lower panel relative to the upper panel to position the lower panel aperture adjacent to the upper panel aperture for providing access to the storage container through the upper and lower panel apertures by hand pressure on the flexible fingers for bending the flexible fingers into the storage container, the flexible fingers enabled by resilient bias thereof for returning to planar congruence when pressure is released therefrom.

2. The apparatus of claim 1 wherein the annular groove of the container cover annular rim is L-shaped and provides a convergent groove side wall surface, a peripheral rim element enabled for resilient reception of the container cover annular rim for lock-action engagement thereof when the cover annular rim is pressed into the convergent side wall surface.

3. The apparatus of claim 2 wherein the annular lip of the storage container provides an outwardly extending lip portion enabled for locking engagement within the annular groove of the container cover annular rim.

4. The apparatus of claim 1 wherein the rotational actuation means is a mushroom shaped handle fixed to the lower panel and extending through the upper panel aperture in a position for manual actuation in rotating the lower panel.

* * * * *